US011377867B2

(12) United States Patent
Liu

(10) Patent No.: US 11,377,867 B2
(45) Date of Patent: Jul. 5, 2022

(54) HEAT REFLECTION TENT

(71) Applicant: Patricia Wanchun Lee Liu, Douliu (TW)

(72) Inventor: Patricia Wanchun Lee Liu, Douliu (TW)

( * ) Notice: Subject to any disclaimer, the term of this patent is extended or adjusted under 35 U.S.C. 154(b) by 417 days.

(21) Appl. No.: 16/722,415

(22) Filed: Dec. 20, 2019

(65) Prior Publication Data

US 2021/0189757 A1 Jun. 24, 2021

(51) Int. Cl.
*E04H 15/12* (2006.01)
*A61H 33/06* (2006.01)

(52) U.S. Cl.
CPC ..... *E04H 15/12* (2013.01); *A61H 33/066* (2013.01); *A61H 2201/0161* (2013.01)

(58) Field of Classification Search
CPC ..... E04H 15/12; A61H 33/066; A61H 2201/0161
USPC ..... 4/524
See application file for complete search history.

(56) References Cited

U.S. PATENT DOCUMENTS 4,031,573 A * 6/1977 Romanoff ..... A61H 33/06 607/83
4,838,293 A * 6/1989 Novak ..... E04H 15/24 135/156
5,950,254 A * 9/1999 Yasue ..... A61H 33/063 4/527
6,055,684 A * 5/2000 Azuma ..... A61H 33/06 4/531
6,148,450 A * 11/2000 Nicholas ..... A61H 33/06 607/81
6,170,097 B1 * 1/2001 Lin ..... A61H 33/06 607/81
6,276,001 B1 * 8/2001 Chen ..... A61H 33/066 4/527
2008/0196152 A1 * 8/2008 Lozano ..... A61H 33/066 4/527
2010/0205736 A1 * 8/2010 Chang ..... A61H 33/066 4/527
2013/0072863 A1 * 3/2013 Nakamura ..... A61H 35/00 604/24
2016/0081875 A1 * 3/2016 Oh ..... A61H 33/066 4/524

* cited by examiner

*Primary Examiner* — Benjamin R Shaw
(74) *Attorney, Agent, or Firm* — Alan D. Kamrath; Karin L. Williams; Mayer & Williams PC

(57) ABSTRACT

A heat-reflection tent has a body and a supporting member. The body has a covering cloth having two covering sheets and a zipper assembly. The zipper assembly is mounted on the covering cloth and has a front zipper and two bottom zippers. The front zipper is located between the two covering sheets. The two bottom zippers are respectively disposed below the two covering sheets. The supporting member is mounted on the body and is used to support the body for keeping a shape of the body. An opened range of the two covering sheets is increased by the bottom zippers for allowing a user to enter the body easily.

20 Claims, 7 Drawing Sheets

HEAT REFLECTION TENT

BACKGROUND OF THE INVENTION

1. Field of the Invention

The present invention relates to a heat-reflection tent, and more particularly to a heat-reflection tent of a portable sauna that has a good supporting capacity and is convenient for a user to pass in and out.

2. Description of Related Art

With reference to FIG. 6, a conventional heat-reflection tent 90 is suitable for a portable sauna and has a body 91 and a zipper 92. The body 91 has a top surface, a front surface, a chamber 94, and a neck opening 93. The chamber 94 is formed in the body 90. The neck opening 93 is formed in the top surface of the body 91 and communicates with the chamber 94 of the body 91. The zipper 92 is mounted on the front surface of the body 91 and extends from a bottom of the front surface of the body 91 to the neck opening 93 of the body 91 for dividing the front surface of the body 91 into two front sheets 95. A user can open the two front sheets 95 of the body 91 by the zipper 92 and enter the chamber 94 of the body 91 via the opened front sheets 95. However, the body 91 of the conventional heat-reflection tent 90 is collapsed easily and can hardly maintain a shape of the body 91 without a supporting structure. The zipper 92 mounted on the collapsed body 91 is hard to open.

With reference to FIG. 7, a heating device 80 is disposed in the chamber 94 of the body 91 adjacent to the front surface of the body 91. A remote control 83 is electrically connected to the heating device 80 and is disposed on the body 91. A footrest 82 is disposed in the chamber 94 of the body 91 and is adjacent to the zipper 92. Two shafts 81 are respectively mounted on two sides of the heating device 80 and are located at two front corners of the conventional heat-reflection tent 90 for supporting two sides of the conventional heat-reflection tent 90. The shape of the body 91 can be maintained by the two shafts 81. The zipper 92 is easy to be opened or closed.

However, the heating device 80 is adjacent to the front surface of the body 91 and is adjacent to the bottom of the zipper 92. When the user opens the zipper 92 and enters the chamber 94 of the body 91, the user needs to step over the footrest 82. Elderly people or people with injured feet may be tripped and injured by the footrest 82 during the process of stepping into the chamber 94 of the body 91. In addition, the zipper 92 is opened to separate the two front sheets 95. Bottoms of the two front sheets 95 are still connected to a bottom surface of the body 91. The opening diameter of the zipper 92 is decreased downwardly. The difficulty for the user to step into the chamber 94 of the body 91 is increased.

To overcome the shortcomings, the present invention provides a heat-reflection tent to mitigate or obviate the aforementioned problems.

SUMMARY OF THE INVENTION

The objective of the invention is to provide a heat-reflection tent that can solve the shortcoming that a supporting capacity of the conventional heat-reflection tent is insufficient, causing inconvenience in operating the zipper, and the difficulty for the user to step into the chamber of the body is increased by the conventional heat-reflection tent with the heating device and the two shafts.

The heat-reflection tent has a body and a supporting member. The body has a covering cloth and a zipper assembly. The covering cloth has a front portion, a top surface, a bottom surface, two side surfaces, an inner surface, a front surface, a chamber, and a neck opening. The front portion of the covering cloth has a bottom and two covering sheets. The two covering sheets are disposed beside each other. The front surface of the covering cloth is formed on the front portion of the covering cloth. The chamber is formed in the covering cloth. The neck opening of the covering cloth is formed in the top surface of the covering cloth and communicates with the chamber of the covering cloth.

The zipper assembly is mounted on the covering cloth and has a front zipper and two bottom zippers. The front zipper is mounted on the front portion of the covering cloth, is located between the two covering sheets of the front portion, and upwardly extends from the bottom of the front portion to the neck opening. The two bottom zippers are mounted on the bottom of the front portion, are respectively disposed on the two covering sheets of the front portion, and extend to the front zipper.

The supporting member is mounted on the body and has a bottom rod and two side rods. The bottom rod is mounted on the covering cloth of the body adjacent to the bottom of the front portion and has two ends adjacent to the two side surfaces of the covering cloth respectively. The two side rods are respectively mounted on the two ends of the bottom rod, extend upwardly, and each side rod has a respective top end. The top ends of the two side rods are respectively connected to the two side surfaces of the covering cloth and extend to the top surface of the covering cloth.

The supporting member is used to support the body for keeping a shape of the body. The supporting member is located adjacent to the front surface of the covering cloth. In use, a shape of the covering cloth can be maintained by the supporting member. The front zipper and the two bottom zippers of the zipper assembly can be opened smoothly by a user. When the two bottom zippers are opened, two bottom portions of the two covering sheets can be separated for increasing an opening range of the two covering sheets. A distance between the two separated covering sheets is increased for allowing the user to enter the chamber easily. A chair or a heat device is easily put into the chamber of the covering cloth. Furthermore, the heating device is disposed in the chamber of the covering cloth according to the needs of the user and is disposed at a position where the user is free from tripping, thereby improving the safety of using the heat-reflection tent.

DETAILED DESCRIPTION OF THE PREFERRED EMBODIMENT

Figure 1:
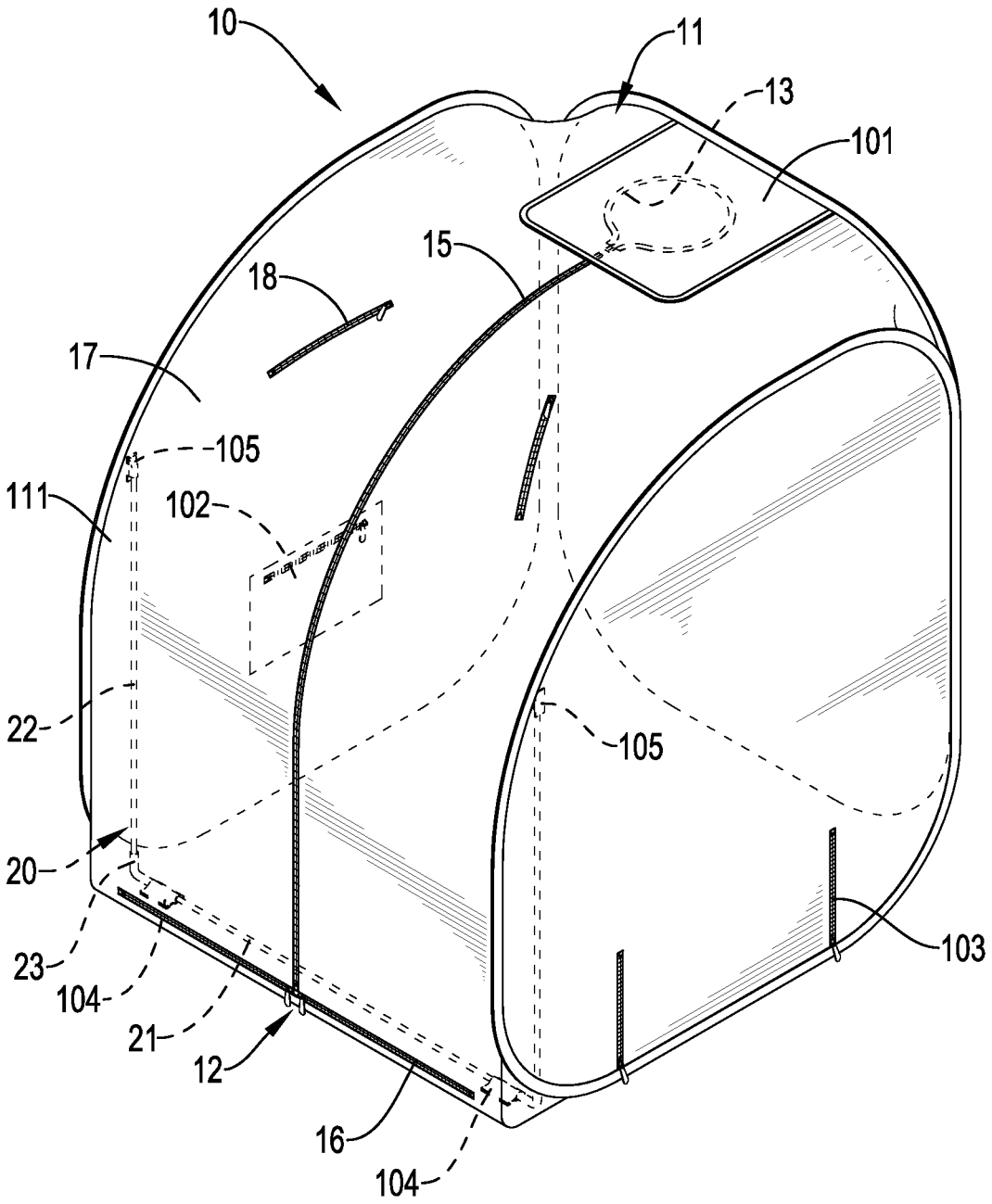
FIG. 1 is a perspective view of a heat-reflection tent in accordance with the present invention.
Figure 2:
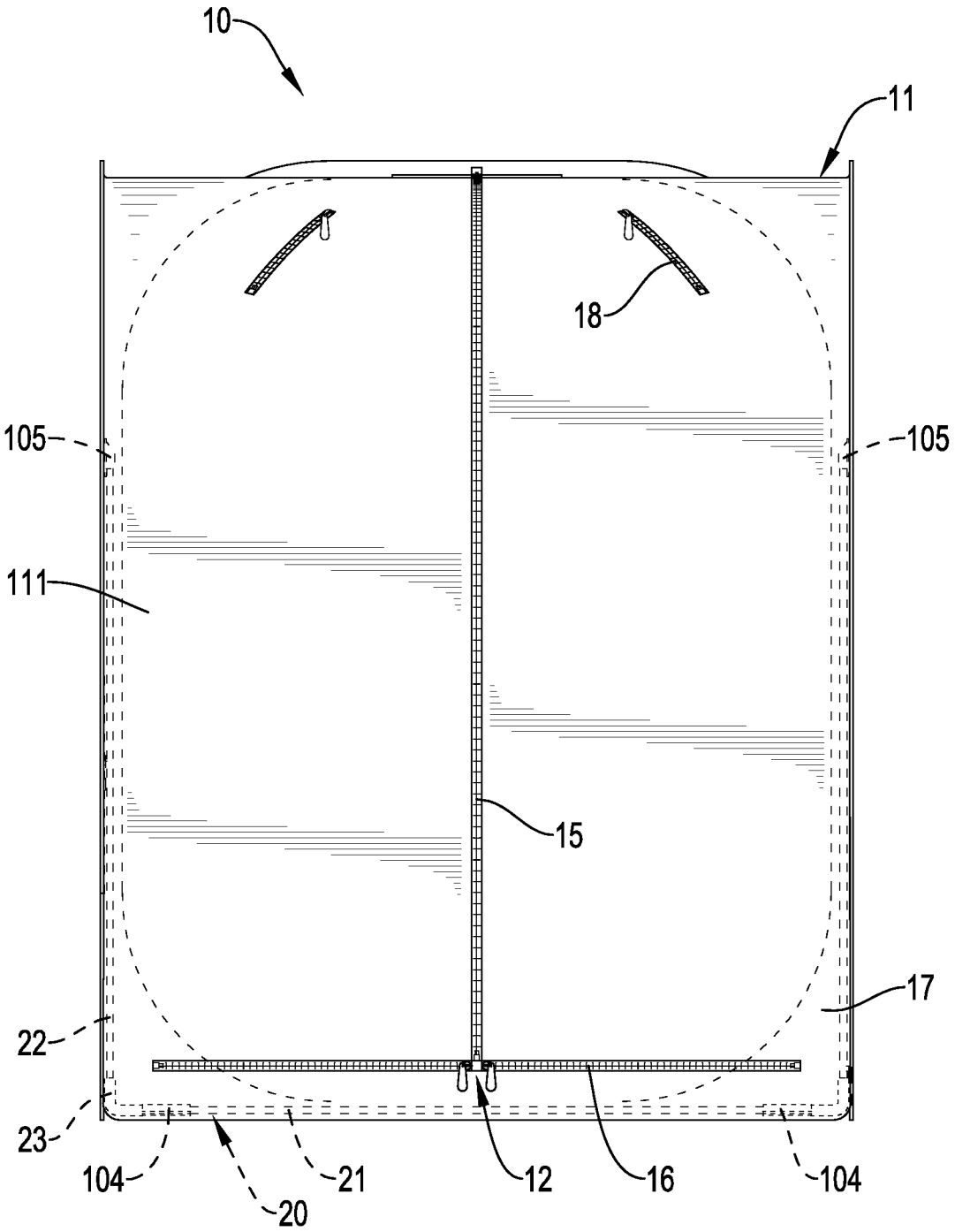
FIG. 2 is a front side view of the heat-reflection tent in FIG. 1.
Figure 3:
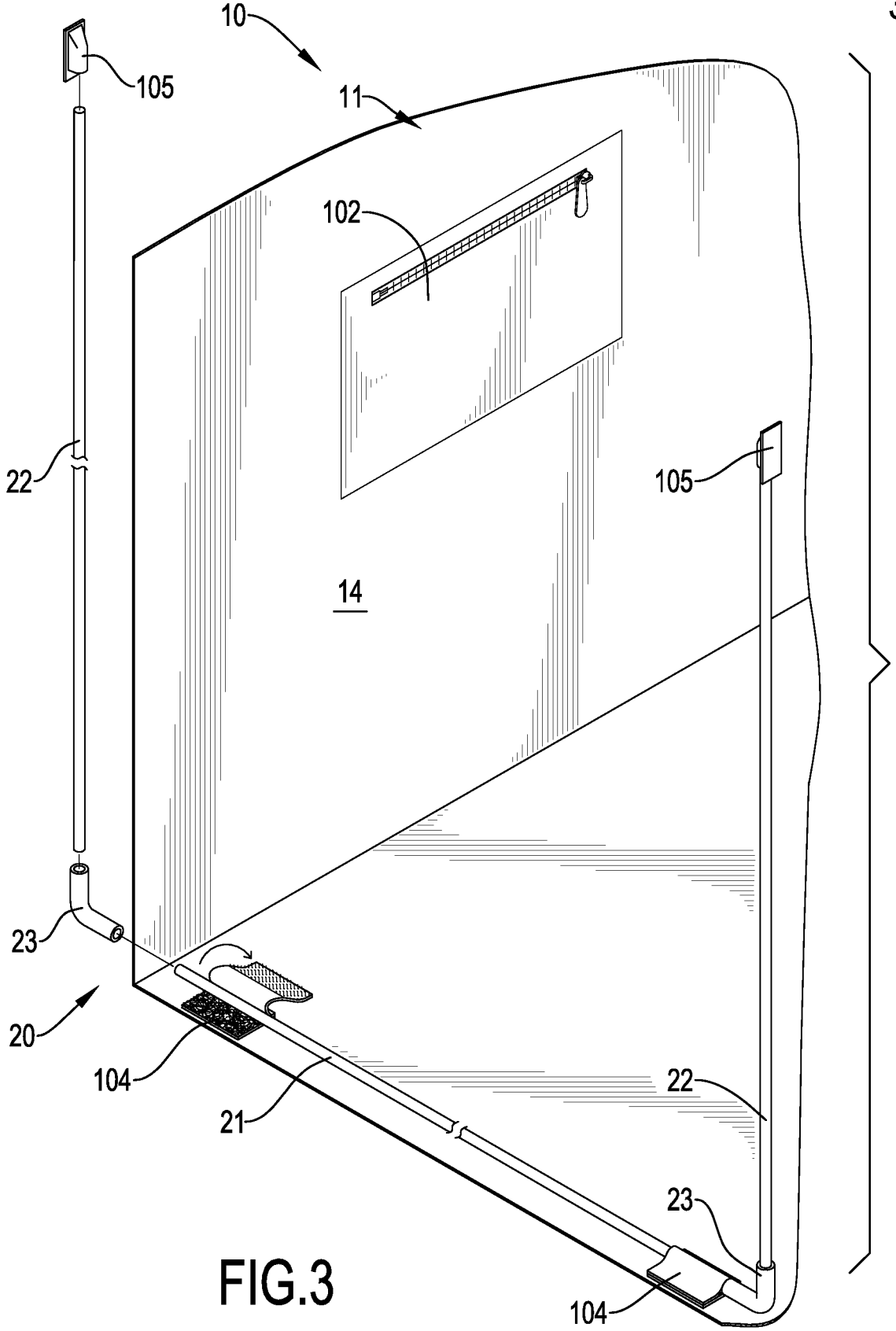
FIG. 3 is an enlarged and exploded perspective view of a supporting member of the heat-reflection tent in FIG. 1.

With reference to FIGS. 1 and 3, a heat-reflection tent in accordance with the present invention comprises a body 10 and a supporting member 20.

The body 10 has a covering cloth 11 and a zipper assembly 12. The covering cloth 11 has a front portion 111, a top surface, a bottom surface, two side surfaces, an inner surface, a front surface, a chamber 14, and a neck opening 13. The front portion 111 of the covering cloth 11 has a bottom and two covering sheets 17 disposed beside each other. The front surface of the covering cloth 11 is formed on the front portion 111 of the covering cloth 11. The chamber 14 is formed in the covering cloth 11. The neck opening 13 is formed in the top surface of the covering cloth 11 and communicates with the chamber 14 of the covering cloth 11. The zipper assembly 12 is mounted on the covering cloth 11 and has a front zipper 15 and two bottom zippers 16. The front zipper 15 is mounted on the front portion 111 of the covering cloth 11, is located between the two covering sheets 17 of the front portion 111, and upwardly extends from the bottom of the front portion 111 to the neck opening 13 of the covering cloth 11. The two bottom zippers 16 are mounted on the bottom of the front portion 111, are respectively disposed on the two covering sheets 17 of the front portion 111, and both extend to the front zipper 15.

Furthermore, the body 10 has a top cover 101, a pocket 102, two side zippers 103, and two hand zippers 18. The top cover 101 is disposed on the top surface of the covering cloth 11 and covers the neck opening 13 of the covering cloth 11. The pocket 102 is disposed on the inner surface of the covering cloth 11. The two side zippers 103 are disposed on one of the two side surfaces of the covering cloth 11 at a spaced interval and both upwardly extend from the bottom surface of the covering cloth 11. The two hand zippers 18 are respectively disposed on the two covering sheets 17 of the covering cloth 11.

The supporting member 20 is mounted on the body 10 and has a bottom rod 21 and two side rods 22. The bottom rod 21 is mounted on the covering cloth 11 of the body 10 adjacent to the bottom of the front portion 111 and has two ends adjacent to the two side surfaces of the covering cloth 11 respectively. The two side rods 22 are respectively mounted on the two ends of the bottom rod 21, extend upwardly, and each side rod 22 has a respective top end. The top ends of the two side rods 22 are respectively connected to the two side surfaces of the covering cloth 11 and extend to the top surface of the covering cloth 11. Furthermore, the supporting member 20 is located in the chamber 14 of the covering cloth 11. In addition, the supporting member 10 has two connectors 23. The two connectors 23 are respectively disposed on the two ends of the bottom rod 21. The two side rods 22 are respectively inserted into the two connectors 23. Furthermore, the two connectors 23 are L-shaped components. An inferior angle between each one of the two side rods 22 and the bottom rod 21 is equal to or greater than 90 degrees.

In addition, the body 10 has two positioning elements 104 and two side covers 105. The two positioning elements 104 are disposed on the covering cloth 11 and are respectively located adjacent to the two ends of the bottom rod 21. The bottom rod 21 is inserted through the two positioning elements 104 and is connected to the body 10 by the two positioning elements 104. The side covers 105 are disposed on the covering cloth 11 adjacent to a top-front edge of the covering cloth 11, are respectively located adjacent to the covering sheets 17, and respectively cover the two top ends of the two side rods 22.

Figure 4:
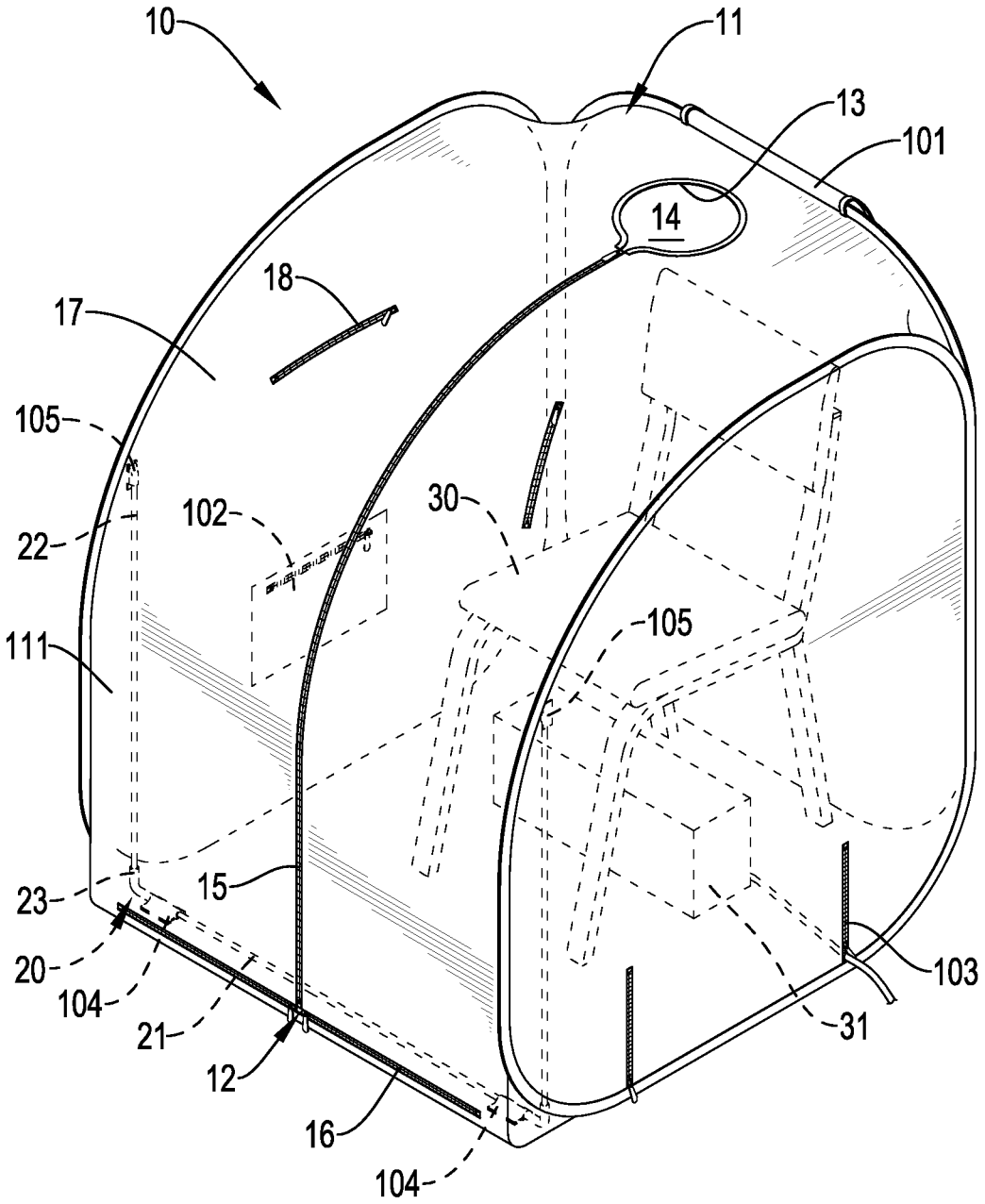
FIG. 4 is an operational perspective view of the heat-reflection tent in FIG. 1.
Figure 5:
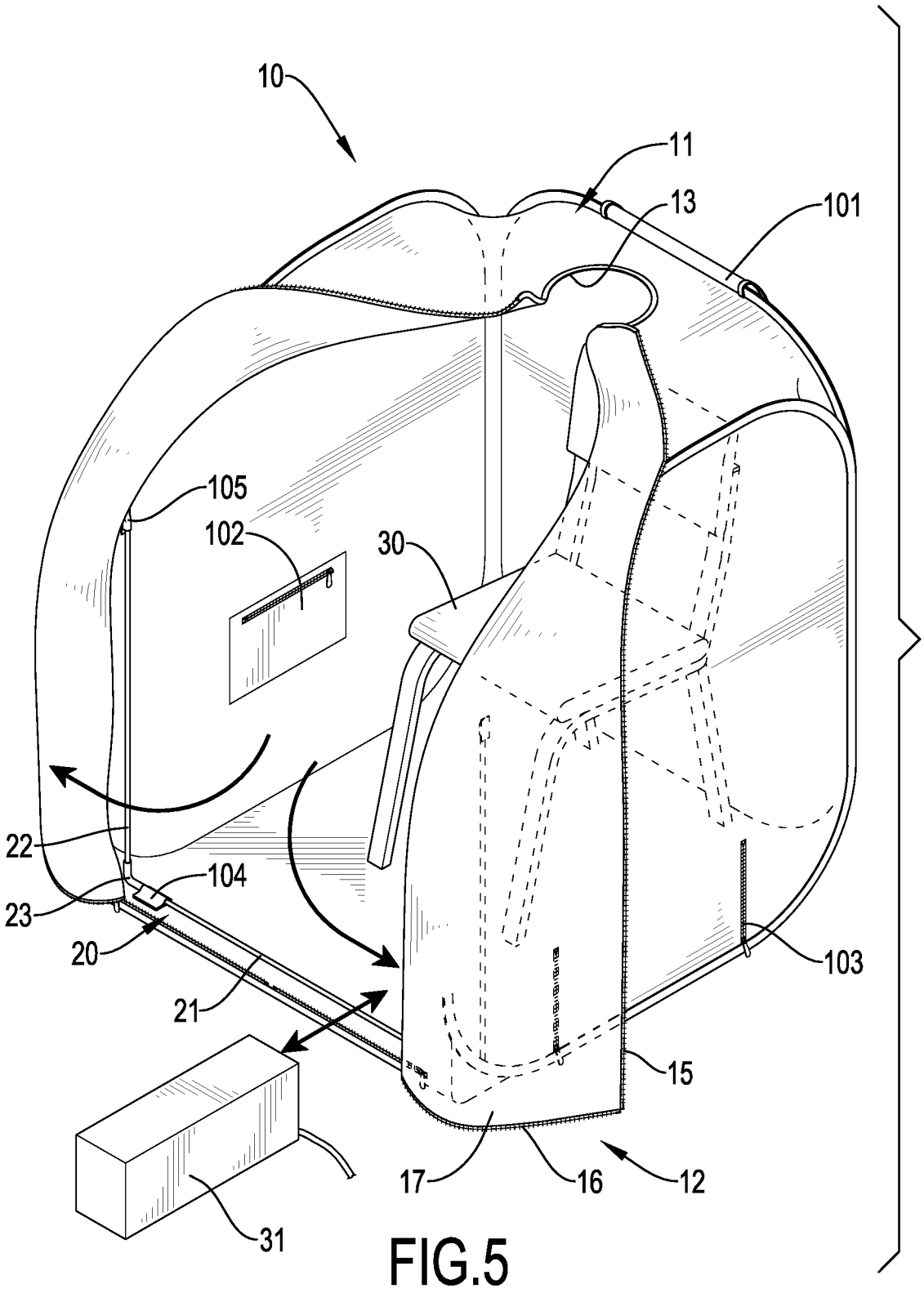
FIG. 5 is another operational perspective view of the heat-reflection tent in FIG. 1.
Figure 6:
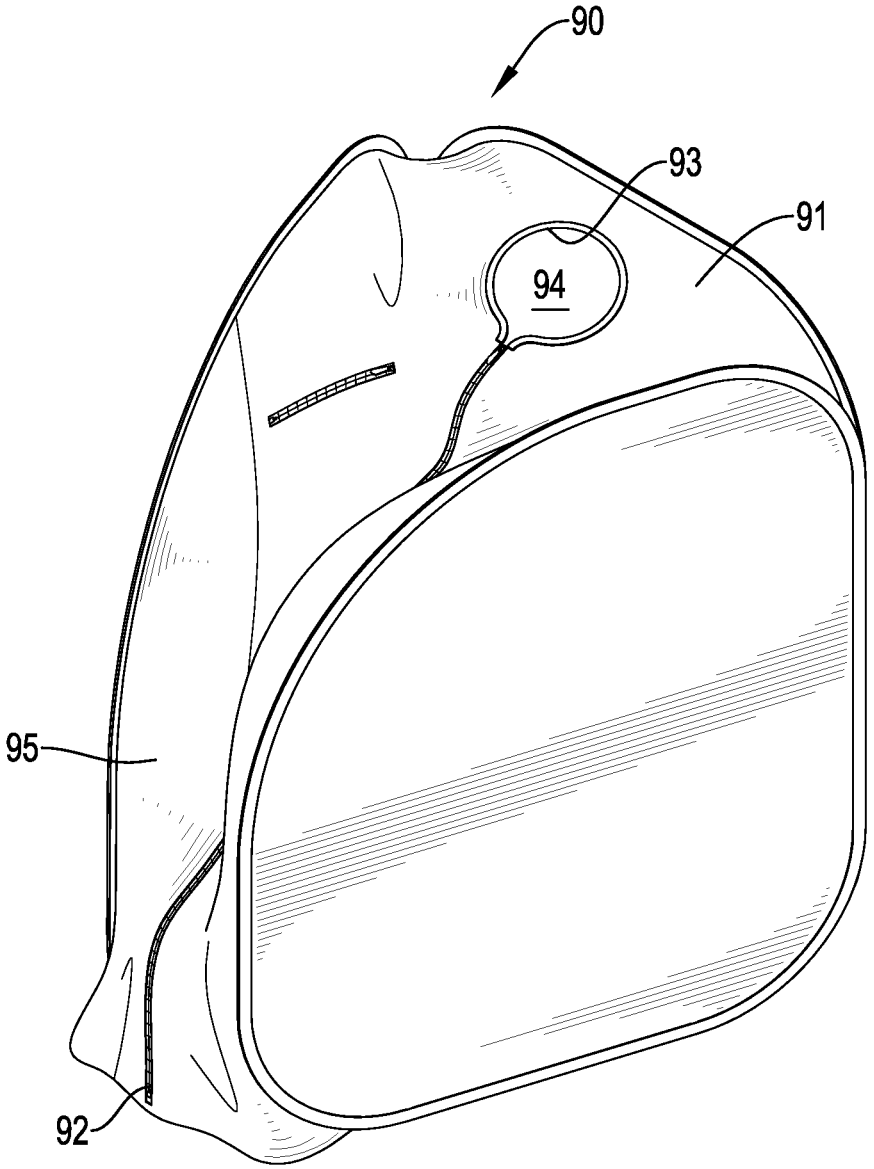
FIG.6 PRIOR ART
FIG. 6 is a perspective view of a heat-reflection tent in accordance with the prior art.
Figure 7:
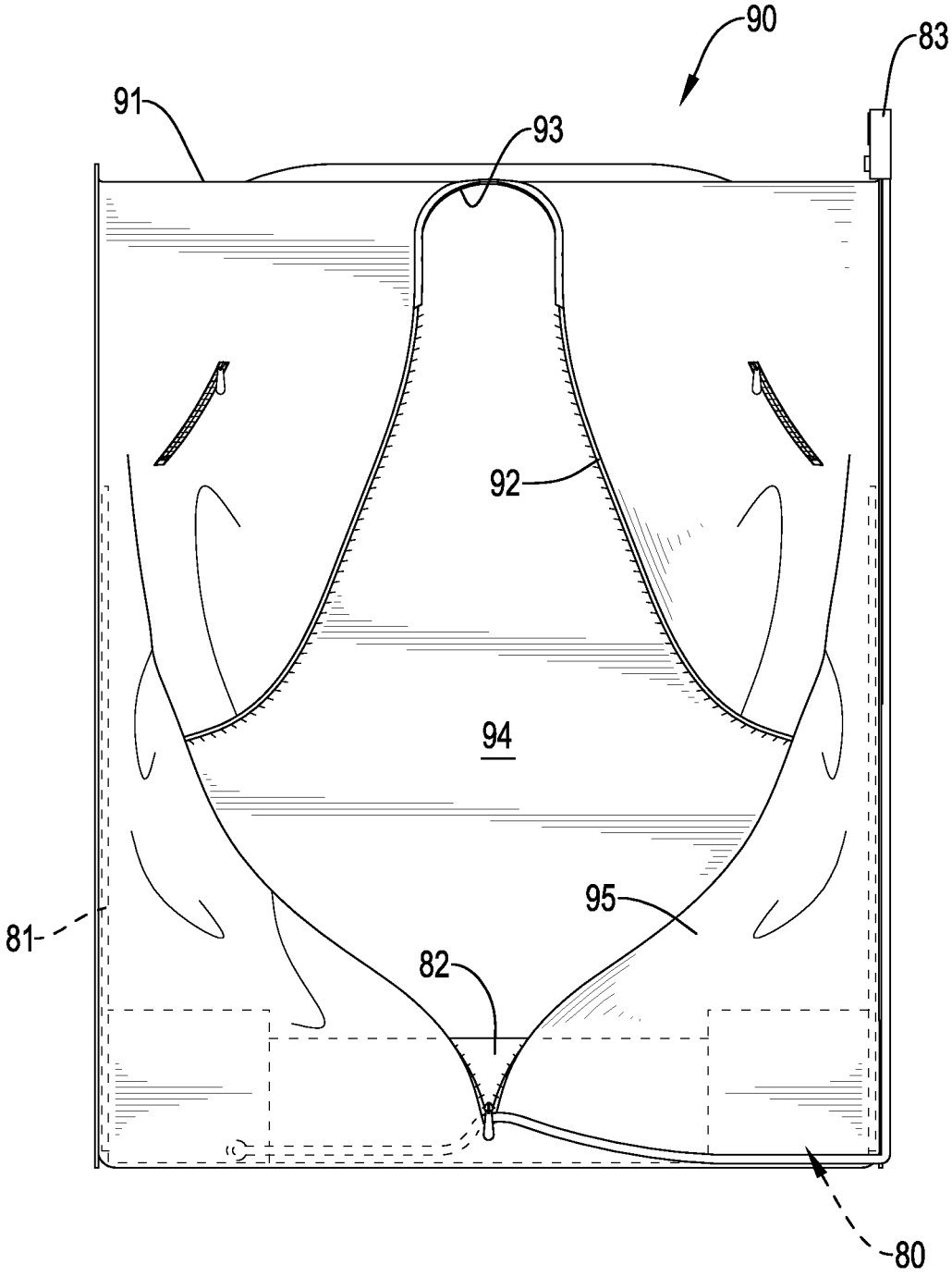
FIG.7 PRIOR ART
FIG. 7 is a front side view of the heat-reflection tent in FIG. 6, showing that a heating device, a footrest, and two shafts are disposed in the heat-reflection tent.

With reference to FIGS. 3 to 5, the body 10 is supported by the supporting member 20. Two sides of the front surface of the covering cloth 11 can stand erectly. When a user opens the zipper assembly 12, the front zipper 15 and the two bottom zippers 16 of the zipper assembly 12 can be opened smoothly and easily. When the zipper assembly is opened, the two covering sheets 17 are opened forward, and two bottom portions of the two covering sheets 17 can be separated for increasing an opening range of the two covering sheets 17. The two side rods 22 of the supporting member 20 are covered by the two side covers 105 of the covering cloth 11 and respectively support two sides of the covering cloth 11. The two sides of the covering cloth 11 can stand erectly and firmly.

The opening range of the two covering sheets 17 is increased by the two bottom zippers 16. The covering cloth 11 is supported by the two side rods 22 of the supporting member 20 for keeping a shape of the covering cloth 11. A chair 30 can be easily put into the chamber 14 of the covering cloth 11 via the opened covering sheets 17. The bottom rod 21 of the supporting member 20 is positioned by the two positioning elements 104 of the body 10. The user can step over the bottom rod 21 easily and is not tripped by the bottom rod 21 for increasing the safety in use of the heat-reflection tent.

Furthermore, a heating device 31 can be put into the chamber 14 of the covering cloth 11 via the opened covering sheets 17. A wire of the heating device 31 can extend out of the covering cloth 11 via one of the opened side zippers 103. The heating device 31 is used to heat air in the chamber 14 of the covering cloth 11. The heated air can be reflected in the heat-reflection tent for the user to enjoy sauna. In addition, the heat device 31 can be controlled by a remote control (not shown in figures). The remote control can be disposed on a top edge of the covering cloth 11. A skidproof material is disposed between the covering cloth 11 and the remote control, thereby the remote control is steadily disposed on the covering cloth 11.

In addition, the neck opening 13 of the covering cloth 11 can be opened or closed by the top cover 101. The top cover 101 can cover the neck opening 13 of the covering cloth 11 for preventing the heated air in the chamber 14 of the covering cloth 11 from escaping. The pocket 102 allows the user to store the carry-on items for increasing the convenience of using the heat-reflection tent.

In addition, the supporting member 20 is disposed in the chamber 14 of the covering cloth 11 or is disposed out of the covering cloth 11. The supporting member 20 is located adjacent to the front surface of the covering cloth 11. The disposed position of the supporting member 20 is not limited.

In addition, the inferior angle between each one of the two side rods 22 and the bottom rod 21 is equal to 90 degrees. The two side rods 22 extend upwardly and erectly and are inserted into the two side covers 105. When the inferior angle between each one of the two side rods 22 and the bottom rod 21 is greater than 90 degrees, a distance between the top ends of the two side rods 22 is larger than a distance between the bottom ends of the two side rods 22. Tension of the front surface of the covering cloth 11 adjacent to the top surface of the covering cloth 11 is increased, thereby the covering cloth 11 is not easy to collapse. The supporting member 20 is positioned on the body 10 by the two positioning elements 104 and the two side covers 105, and firmly supports the body 10.

In use, the heating device 31 heats the air in the chamber 14 of the covering cloth 11. The user enters the chamber 14 of the covering cloth 11 via the opened covering sheets 17, sits on the chair, and closes the front zipper 15 and the two bottom zippers 16. A neck of the user sticks out through the neck opening 13 of the covering cloth 11. Two hands of the user can stick out of the covering cloth 11 via the opened hand zippers 18.

Accordingly, the body 10 of the heat-reflection tent is supported by the supporting member 20 and stands erectly for keeping the shape of the body 10 in use. The zipper assembly 12 can be pulled smoothly and easily. The bottom portions of the two covering sheets 17 can be separated from the bottom surface of the covering cloth 11 by the opened bottom zippers 16 for increasing the opening range of the two covering sheets 17. A distance between the two separated covering sheets 17 is increased for allowing the user to enter the chamber 14 of the covering cloth 11 easily, conveniently, and securely.

What is claimed is:

1. A heat-reflection tent comprising:

a body having a covering cloth having a front portion having a bottom and two covering sheets disposed beside each other;

a top surface;

a bottom surface;

two side surfaces;

an inner surface;

a front surface formed on the front portion of the covering cloth;

a chamber formed in the covering cloth; and a neck opening formed in the top surface of the covering cloth and communicating with the chamber of the covering cloth; and a zipper assembly mounted on the covering cloth, and having a front zipper mounted on the front portion of the covering cloth, located between the two covering sheets of the front portion, and upwardly extending from the bottom of the front portion to the neck opening of the covering cloth; and two bottom zippers mounted on the bottom of the front portion, respectively disposed on the two covering sheets of the front portion, and extending to the front zipper; and a supporting member mounted on the body, and having a bottom rod mounted on the covering cloth of the body adjacent to the bottom of the front portion, and having two ends adjacent to the two side surfaces of the covering cloth respectively; and two side rods respectively mounted on the two ends of the bottom rod, extending upwardly, and each having a top end connected to one of the two side surfaces of the covering cloth and extending to the top surface of the covering cloth.

2. The heat-reflection tent as claimed in claim 1, wherein the body has a top cover disposed on the top surface of the covering cloth and covering the neck opening of the covering cloth;

a pocket disposed on the inner surface of the covering cloth;

two side zippers disposed on one of the two side surfaces of the covering cloth at a spaced interval, and upwardly extending from the bottom surface of the covering cloth; and two hand zippers respectively disposed on the two covering sheets of the covering cloth.

3. The heat-reflection tent as claimed in claim 1, wherein the supporting member is located in the chamber of the covering cloth.

4. The heat-reflection tent as claimed in claim 2, wherein the supporting member is located in the chamber of the covering cloth.

5. The heat-reflection tent as claimed in claim 1, wherein the supporting member has two connectors, the two connectors are respectively disposed on the two ends of the bottom rod, and the two side rods are respectively inserted into the two connectors.

6. The heat-reflection tent as claimed in claim 2, wherein the supporting member has two connectors, the two connectors are respectively disposed on the two ends of the bottom rod, and the two side rods are respectively inserted into the two connectors.

7. The heat-reflection tent as claimed in claim 3, wherein the supporting member has two connectors, the two connectors are respectively disposed on the two ends of the bottom rod, and the two side rods are respectively inserted into the two connectors.

8. The heat-reflection tent as claimed in claim 4, wherein the supporting member has two connectors, the two connectors are respectively disposed on the two ends of the bottom rod, and the two side rods are respectively inserted into the two connectors.

9. The heat-reflection tent as claimed in claim 5, wherein the two connectors are L-shaped components, and an inferior angle between each one of the two side rods and the bottom rod is equal to or greater than 90 degrees.

10. The heat-reflection tent as claimed in claim 6, wherein the two connectors are L-shaped components, and an inferior angle between each one of the two side rods and the bottom rod is equal to or greater than 90 degrees.

11. The heat-reflection tent as claimed in claim 7, wherein the two connectors are L-shaped components, and an inferior angle between each one of the two side rods and the bottom rod is equal to or greater than 90 degrees.

12. The heat-reflection tent as claimed in claim 8, wherein the two connectors are L-shaped components, and an inferior angle between each one of the two side rods and the bottom rod is equal to or greater than 90 degrees.

13. The heat-reflection tent as claimed in claim 1, wherein the body has two positioning elements disposed on the covering cloth and respectively located adjacent to the two ends of the bottom rod, wherein the bottom rod is inserted through the two positioning elements and is connected to the body by the two positioning elements; and two side covers disposed on the covering cloth adjacent to a top-front edge of the covering cloth, respectively located adjacent to the covering sheets, and respectively covering the two top ends of the two side rods.

14. The heat-reflection tent as claimed in claim 2, wherein the body has two positioning elements disposed on the covering cloth and respectively located adjacent to the two ends of the bottom rod, wherein the bottom rod is inserted through the two positioning elements and is connected to the body by the two positioning elements; and two side covers disposed on the covering cloth adjacent to a top-front edge of the covering cloth, respectively located adjacent to the covering sheets, and respectively covering the two top ends of the two side rods.

15. The heat-reflection tent as claimed in claim 3, wherein the body has two positioning elements disposed on the covering cloth and respectively located adjacent to the two ends of the bottom rod, wherein the bottom rod is inserted through the two positioning elements and is connected to the body by the two positioning elements; and two side covers disposed on the covering cloth adjacent to a top-front edge of the covering cloth, respectively located adjacent to the covering sheets, and respectively covering the two top ends of the two side rods.

16. The heat-reflection tent as claimed in claim 4, wherein the body has two positioning elements disposed on the covering cloth and respectively located adjacent to the two ends of the bottom rod, wherein the bottom rod is inserted through the two positioning elements and is connected to the body by the two positioning elements; and two side covers disposed on the covering cloth adjacent to a top-front edge of the covering cloth, respectively located adjacent to the covering sheets, and respectively covering the two top ends of the two side rods.

17. The heat-reflection tent as claimed in claim 5, wherein the body has two positioning elements disposed on the covering cloth and respectively located adjacent to the two ends of the bottom rod, wherein the bottom rod is inserted through the two positioning elements and is connected to the body by the two positioning elements; and two side covers disposed on the covering cloth adjacent to a top-front edge of the covering cloth, respectively located adjacent to the covering sheets, and respectively covering the two top ends of the two side rods.

18. The heat-reflection tent as claimed in claim 6, wherein the body has two positioning elements disposed on the covering cloth and respectively located adjacent to the two ends of the bottom rod, wherein the bottom rod is inserted through the two positioning elements and is connected to the body by the two positioning elements; and two side covers disposed on the covering cloth adjacent to a top-front edge of the covering cloth, respectively located adjacent to the covering sheets, and respectively covering the two top ends of the two side rods.

19. The heat-reflection tent as claimed in claim 7, wherein the body has two positioning elements disposed on the covering cloth and respectively located adjacent to the two ends of the bottom rod, wherein the bottom rod is inserted through the two positioning elements and is connected to the body by the two positioning elements; and two side covers disposed on the covering cloth adjacent to a top-front edge of the covering cloth, respectively located adjacent to the covering sheets, and respectively covering the two top ends of the two side rods.

20. The heat-reflection tent as claimed in claim 8, wherein the body has two positioning elements disposed on the covering cloth and respectively located adjacent to the two ends of the bottom rod, wherein the bottom rod is inserted through the two positioning elements and is connected to the body by the two positioning elements; and two side covers disposed on the covering cloth adjacent to a top-front edge of the covering cloth, respectively located adjacent to the covering sheets, and respectively covering the two top ends of the two side rods.

* * * * *